United States Patent [19]

Hirose

[11] Patent Number: 4,956,950

[45] Date of Patent: Sep. 18, 1990

[54] ASSEMBLY OF EAVES FASCIA

[75] Inventor: Norio Hirose, Gifu, Japan

[73] Assignee: Sunrail Co., Ltd., Gifu, Japan

[21] Appl. No.: 290,150

[22] Filed: Dec. 27, 1988

[30] Foreign Application Priority Data

| | | | |
|---|---|---|---|
| Feb. 8, 1988 | [JP] | Japan | 63-15536[U] |
| Feb. 8, 1988 | [JP] | Japan | 63-15537[U] |
| Mar. 15, 1988 | [JP] | Japan | 63-34304[U] |

[51] Int. Cl.[5] ..... A63H 23/04; E04D 13/00

[52] U.S. Cl. ..... 52/94; 52/11

[58] Field of Search ..... 52/94–96, 52/11, 90, 66; 248/48.1, 48.2

[56] References Cited

U.S. PATENT DOCUMENTS

| | | | |
|---|---|---|---|
| 3,344,562 | 10/1967 | Miles et al. | 52/96 X |
| 3,344,566 | 10/1967 | Miles et al. | 52/94 |
| 3,436,877 | 4/1969 | Gunning | 52/94 X |
| 3,874,131 | 4/1975 | Webster | 52/11 |
| 4,148,164 | 4/1979 | Humphrey | 52/94 |
| 4,261,143 | 4/1981 | Rizzo | 52/11 X |
| 4,263,756 | 4/1981 | Middleby | 52/11 |
| 4,461,128 | 7/1984 | Knoebl | 52/94 |

*Primary Examiner*—David A. Scherbel
*Assistant Examiner*—Michele A. Van Patten
*Attorney, Agent, or Firm*—Schweitzer & Cornman

[57] ABSTRACT

An assembly of eaves fascia, comprising: a fascia board for concealing a plurality of outward ends of rafters arranged in the roof eaves of a building; an eaves soffit board, set apart under the eaves, for obstructing a view of the inside of the eaves from below, an inward end of the soffit board being fixed onto an outer wall of the building; a curtain board, caused to link the fascia board and an outward end of the soffit board, for masking a gap between the eaves and the soffit board; wherein a joint of the fascia board and the curtain board is adapted so as to enable the curtain board to move relative to and around the fascia board, whereby the curtain board can be supported even in a tilted manner by the fascia board. In addition, the above-mentioned assembly of eaves fascia is adapted to connect the curtain board with an additional curtain board so as to extend downwards.

6 Claims, 8 Drawing Sheets

ASSEMBLY OF EAVES FASCIA

BACKGROUND OF THE INVENTION

The present invention relates to an eaves fascia for concealing the outward ends of rafters projecting in the eaves parts of a building roof, and furthermore for concealing the inside of the eaves.

Hitherto, it is known widely in the art to employ a long strip of board member (described hereinafter as a fascia board) as an eaves fascia and thereby conceal the projecting outward ends of a plurality of rafters arranged in the eaves parts of a building roof so that the lower edges of the eaves parts give a simple and good-looking impression. The fascia board of such a nature is utilized also as a member for mounting a rain water gutter along the edges of the eaves. In this case, the work of mounting the gutter on the eaves is troublesome because the corresponding mounting sites are relatively high above the ground.

However, since the above-mentioned fascia boards are secured only to the ends of the eaves, the downward insides of the eaves are exposed to the open air. As this result, the eaves is likely to incur damage by virtue of the wind and the rain.

With the view of the aforesaid fact and the external appearance of the downward insides of the eaves, a covering boards (described hereinafter as an eaves soffit board) is used for obstructing the view of the downward inside of the eaves from below, which soffit board is disposed horizontally between the lower terminal edge of the fascia board and the outer wall of the building. In this prior art, the soffit board is directly connected with the fascia board, so that it is necessary to finish the soffit board with acurate dimensions in accordance with a quantity of projection of the eaves measured vertically from the outer wall of the building, while it is necessary to prepare different sizes of soffit boards.

OBJECTS AND SUMMERY OF THE INVENTION

The present invention aims at solving the problems pointed out with respect to the above-described eaves fascia of the conventional type, and has its object to provide an assembly of eaves fascia which can conceal the downward insides of the eaves of a building roof within limits adjustably according to a projection quantity of the eaves measured vertically from the outer wall.

Another object of the present invention is to provide an assembly of eaves fascia which makes it easy to mount a rain water gutter along the edges of the eaves.

Other objects and advantages of the present invention will become apparent from the detailed description given hereinafter; it should be understood, however, that the detailed description and specific embodiments are given by way of illustrations only, since various changes and modifications within the spirits and scope of the invention will become apparent to those skilled in the art from this detailed description and drawings.

According to the present invention, there is provided an assembly of eaves fascia which comprises a fascia board for concealing a plurality of outward ends of rafters arranged in the roof eaves of a building; an eaves soffit board, set apart under the eaves, for obstructing a view of the inside of the eaves from below, an inward end of the soffit board being fixed onto an outer wall of the building; a curtain board, caused to link the fascia board and an outward end of the soffit board, for masking a gap between the eaves and the soffit board; wherein a joint of the fascia board and the curtain board is adapted so as to enable the curtain board to move relative to and around the fascia board, whereby the curtain board can be supported even in a tilted manner by the fascia board.

DETAILED DESCRIPTION OF THE PREFERRED EMBODIMENTS

Figure 1:
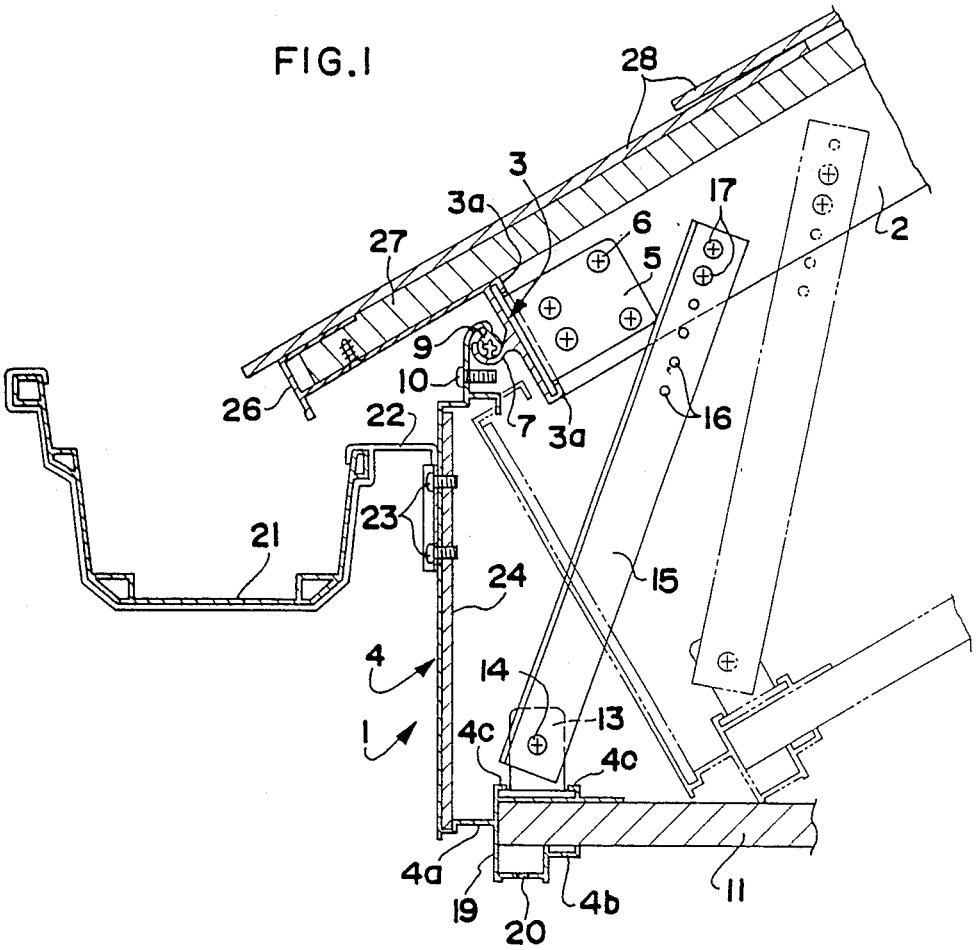
FIG. 1 shows the cross section of the preferred embodiment of an eaves fascia.

Referring first to FIG. 1, the numeral reference 1 generally designates an assembly of eaves fascia, which comprises a fascia board 3 for concealing the outward ends of projecting rafters 2 arranged in the eaves part of a building roof; an eaves soffit board 11, set apart under the eaves part, for obstructing a view of the downward insides of the eaves from below; and a curtain board 4 for concealing the insides of the eaves from the laterial side, i.e. for masking the gap between both of the eaves and the soffit board 11, wherein the curtain board 4 is caused to link the fascia board 3 and the outer end of the eaves soffit board 11, as described hereinafter more in details. The fascia board 3 and the curtain board 4 are made out of aluminum into the respective extruded sections.

In the above-mentioned fascia board 3, its upper and lower terminals are provided, on the back side, longitudinally and integrally with a pair of engaging portions 3*a* bent opposingly toward the middle and having each recess. The respective engaging portions 3*a* are engaged with a connecting means 5, e.g. a L-shaped bracket, which is fixed with wood screws 6 onto the side of the rafter 2, whereby the fascia board 3 is secured firmly to the rafters 2. In the other hand, on the outer surface of the fascia board 3, its longitudinal and middle portion is provided integrally with an outward protrusion 7 having an upward open groove shaped like a concave arc in cross section, for supporting the curtain board 4. The supporting protrusion takes hold of an upper end portion of the curtain board 4 as described hereinafter. In the embodiment illustrated in the drawings, the upper terminal of the fascia board is furthermore provided integrally with an outwards extended portion 26 for covering a sheathing board 27 for tiles and slates 28 which projects outwards from the end of the rafter 2.

In the curtain board 4, its upper end portion is bent downwards in an inverse U shape in cross section, while its extreme edge is provided longitudinally and integrally with a hanging portion 9 expanded in the form of a circle in cross section, so as to associate swingably and detachably with the above-mentioned supporting protrusion 7 of the fascia board 3. As illustrated in FIG. 1, the upper end portion of the curtain board 4 is hanged on the fascia board 3, in such a manner as to fit the bar like hanging portion 9 into the groove of the protrusion 7. In the other hand, its lower terminal is provided, on the back side, longitudinal and integrally with a backwards projecting bifurcated hollow sustaining portion 4*a*,4*b*, wherein the outward end of the eaves soffit board 11 is sustained in an inserted and sandwiched condition. The inward end of the eaves soffit board 11 is fixed to a side wall (not show in FIG. 1) of the building.

Figure 4:
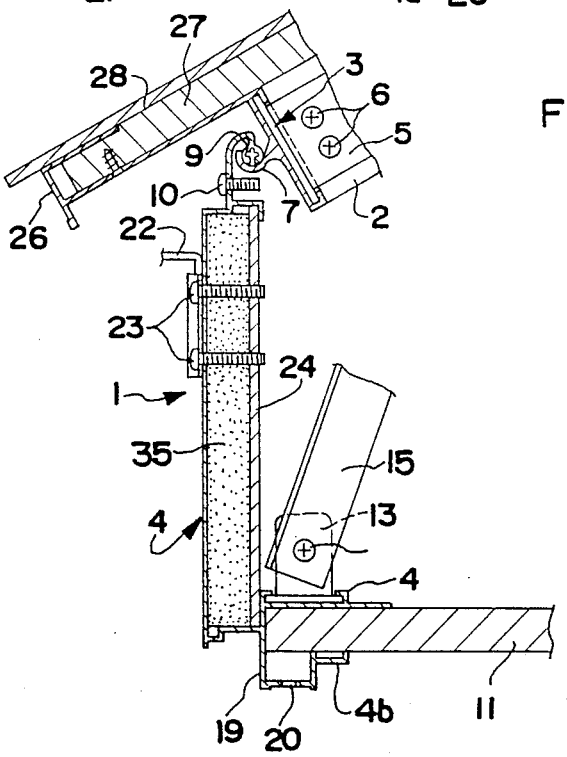
FIG. 4 shows the invention with a heat insulating member.

The reference numerals 21 and 22 designate a rain water gutter and a support respectively. The gutter 21 is mounted on the outer surface of the curtain board 4 by way of the support 22 fixed thereto. These gutter 21 and support 22 are beforehand attached to the curtain board 4 in a manner described above, prior to hanging the curtain board 4 on the fascia board 3. The reference numeral 24 designates a stiffening pad mounted on the back surface of the curtain board 4. Both of the curtain board 4 and the stiffening pad 24 may be so united as to sandwich therebetween a heat insulating member, e.g. a thick plaster board 35, as illustrated in FIG. 4.

As described above, the fascia board 3 and the curtain board 4 have the respective joint portions shaped so as to associate fittingly with one another, so that the connection of these two members can be performed easily only by a simple work of hooking the hanging portion 9 of the former member 3 on the protrusion 7 of the latter member 4, and at the same time the gutter 21 can be indirectly and easily attached to the fascia board 3 or the eaves, owing to beforehand mounting the gutter 21 on the curtain board 4 by way of the supports 22. In addition, since the curtain board 4 is connected swingably with the fascia board 3, the lower end portion of the curtain board 4 can be shifted inwards or outwards relative to a perpendicular plane passing through the protrusion 7 of the fascia board 3. As this result, the lower end portion of the curtain board 4 can be connected even in a tilted condition within limits with different widths of soffit boards, i.e. a relatively long or short width of soffit board in comparison with a quantity of projection of the eaves measured vertically from the outer wall. In the case of using a relative long width of soffit board, it is preferable to tilt the soffit board parallel to the eaves as illustrated by chain lines in FIG. 1.

Figure 2:
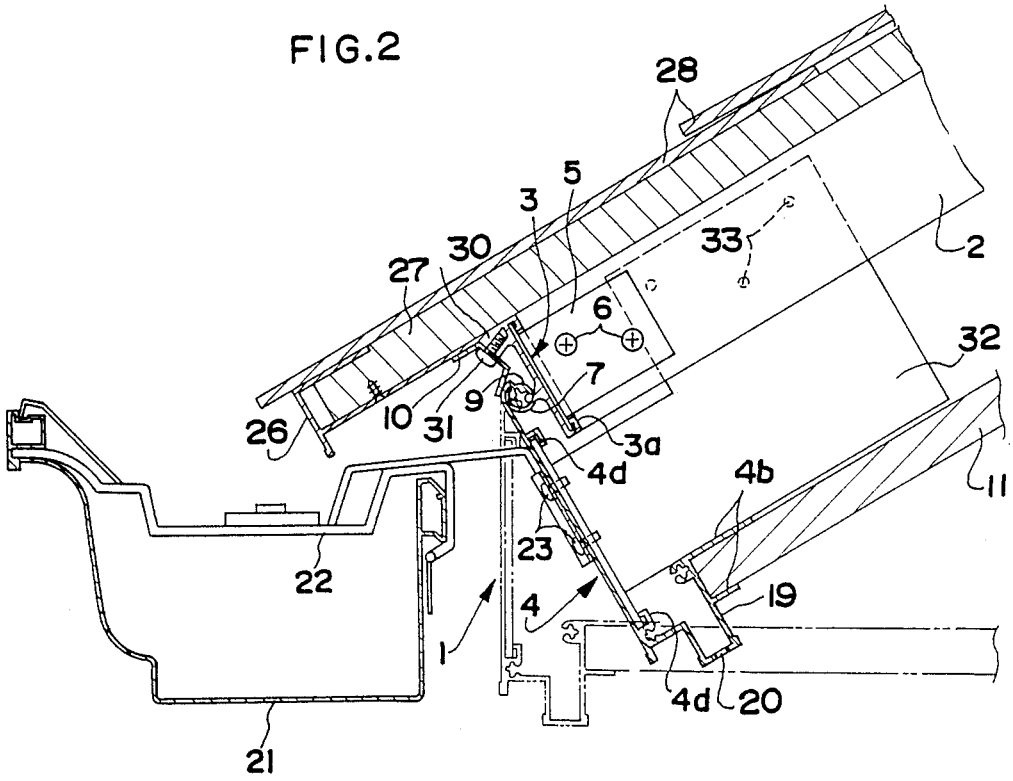
FIGS. 2 and 3 show a further embodiment of the invention having a large plate construction.
Figure 3:
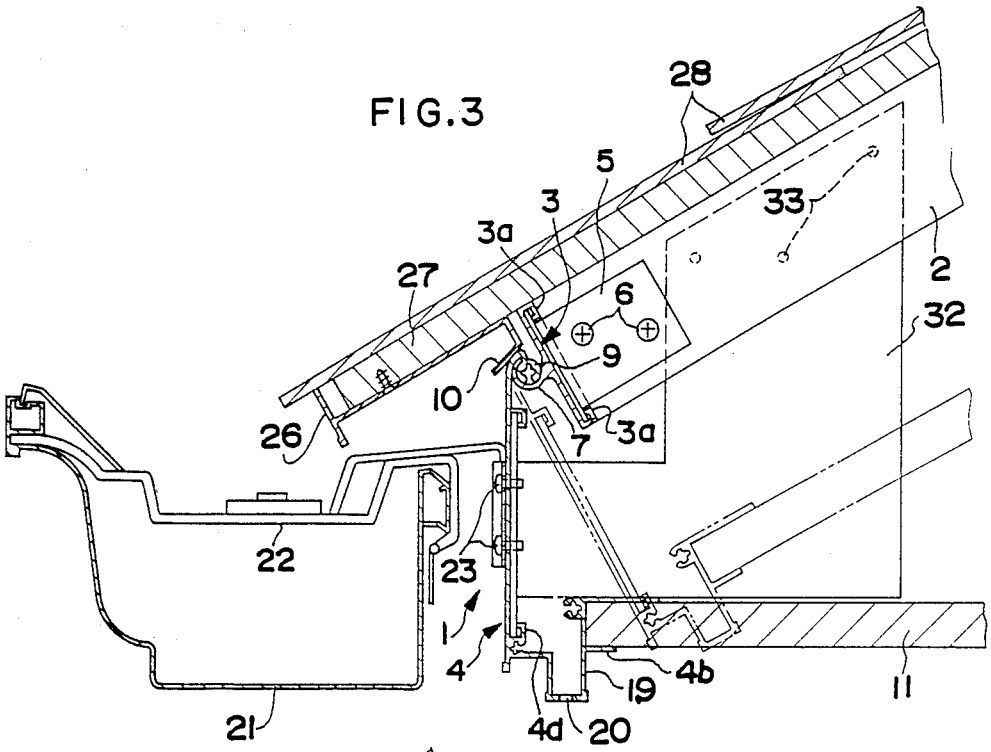

The reference numeral 10 designates a regulating means for preventing the hanging portion 9 of the curtain board 4 from slipping off the groove of the protrusion 7 of the fascia board 3. In the embodiment of FIG. 1, a bolt 10 is used as the above mentioned slipping-off prevention means, which is fixed to the upper end portion of the curtain board 4 in a projecting manner at a lower position than the protrusion 7 of the fascia board 3. In addition to such a bolt, as illustrated in FIGS. 2 and 3, a long piece or portion shaped substantially like V in cross section may be used as the above-mentioned slipping-off prevention means, in order to keep the hanging portion of the curtain board by pressing this from above. In FIG. 2, a separate piece member is used, which is fixed with a screw onto the aforesaid extended portion 26 of the curtain board 4. In FIG. 3, a portion extended from covering plate 26 is used as a slipping-off prevention means.

Still more in the embodiments, the soffit board 11 is supported more firmly, as shown in FIG. 1, by a supplementary supporting arm 15 in addition to the curtain board 4. In details, the lower end portion of the supporting arm 15 is connected indirectly to the outward end of the soffit board 11 by way of a bracket 13 fixed engagedly on the sustaining portion 4*b* of the curtain board 4, whereas the upper end portion of the supporting arm 15 is provided with a plurality of small holes 16 or a longitudinally oblong hole so as to adjust an inclination of the curtain board 4, and is fixed with screws 17 on the side of the rafter 2. The above-mentioned supporting arm 15 is replaceable with a relative large plate shaped according to the inclination angles of the curtain board 4 and the soffit board 11, as illustrated in FIGS. 2 and 3.

FIGS. 5 to 9 inclusive show other embodiments of the present invention, adapted either for adjusting the height between both the upper and lower terminals of the curtain board, or for bringing out a change in an appearance of the curtain board. In particular, these other embodiments are so constructed as to joint another curtain board to the lower terminal of the aforesaid curtain board of, for example, the embodiment illustrated in FIG. 1.

Figure 5:
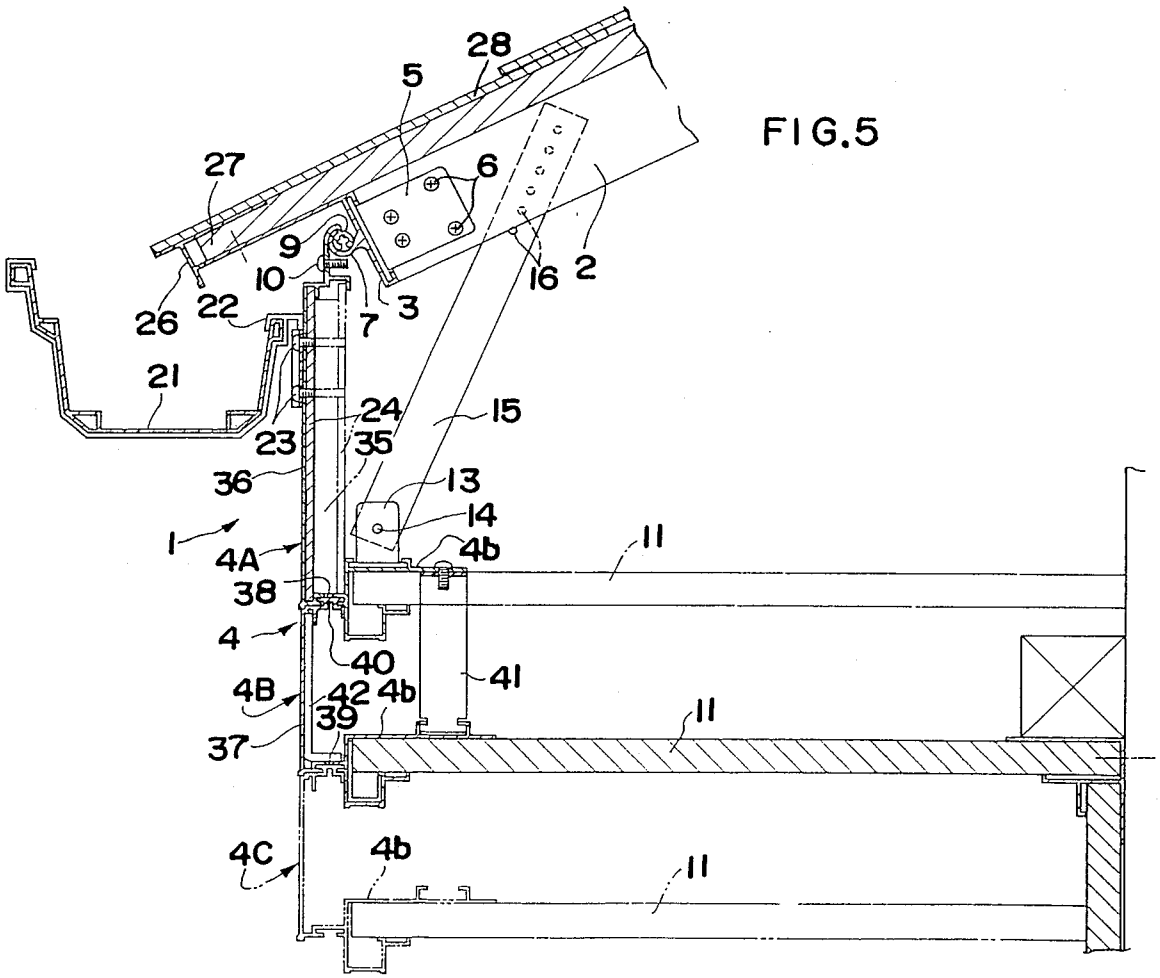
FIGS. 5 through 9 show further embodiments of the present invention.

In FIG. 5, the curtain board 4 consists of an upper main board member 4A which is hanged on the fascia board 3, and a lower secondary board member 4B. The secondary board member 4B is formed into an even face 37, so as to be connected with the main board member 4A in alignment. For the purpose of connecting the secondary board 4B with the main board 4A in an interlocked manner, the mutually opposed projections 38,40 extended backwards from the terminals of the main and secondary boards 4A,4B are formed partially into the respective recess and expansion, in cross section, so as to enable the one to fit on the other. As this result, the lower secondary board 4B is connected with the upper main board steadily and easily by sliding the expansion 40 of the former along the recess 38 of the latter. Otherwise, it may be possible to connect two mutually opposed projections having no recess and expansion by the use of screws. The lower terminal of the secondary board 4B also is provided with a projection 39 and a bifurcated hollow sustaining portion 4*b*, wherein the outward end of the eaves soffit board 11 is sustained in an inserted and sandwiched condition. The total height between both the upper and lower terminals of the curtain board 4 is adjustable by adding one or more extra boards 4B,4C to the main board 4A, as illustrated in FIG. 5 by a continuous line or a two-dot chain line respectively in relation with a one-dot chain line. The numeral 41 shows a connecting piece plate for ensuring the connection of the two main and secondary boards. The numeral 42 shows a stiffening pad mounted on the back side of the lower secondary board 4B.

Figure 6:
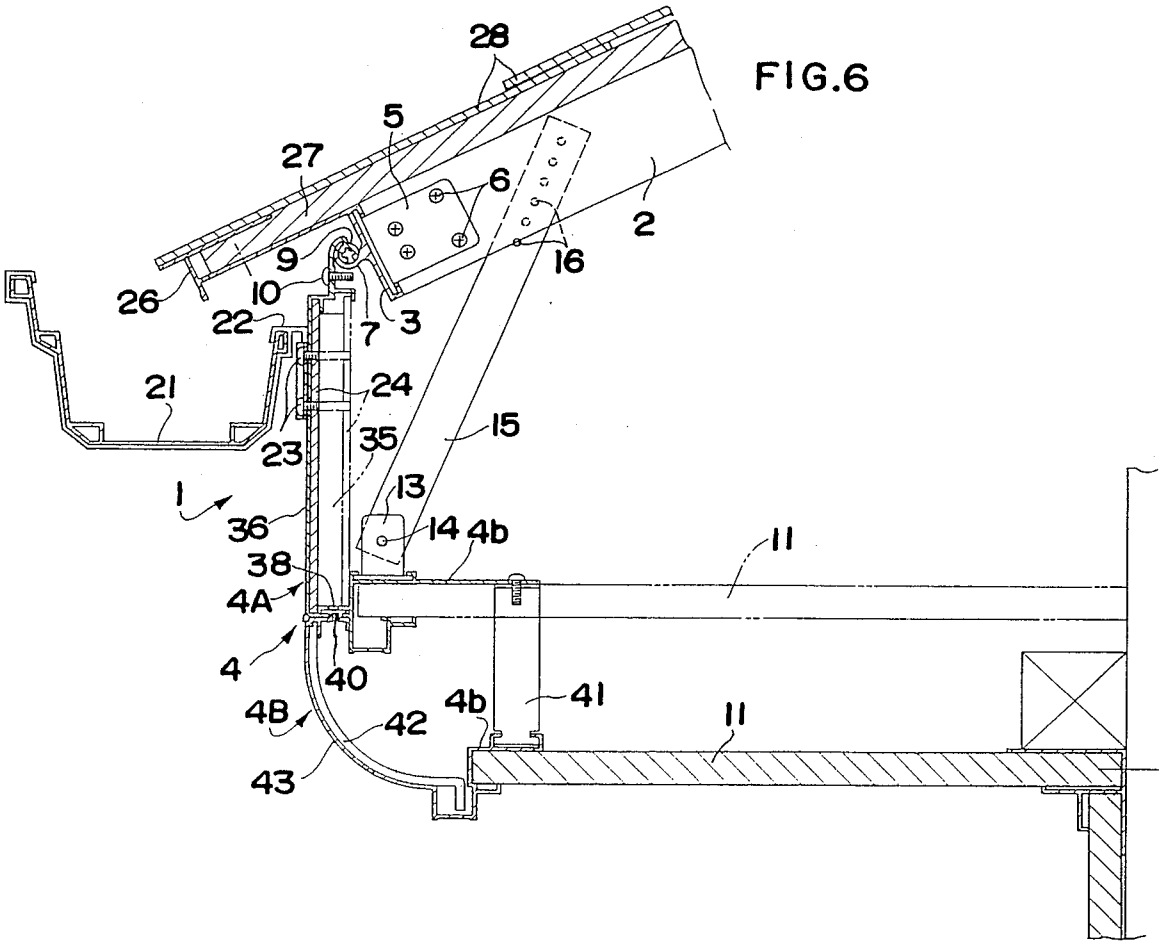
Figure 7:
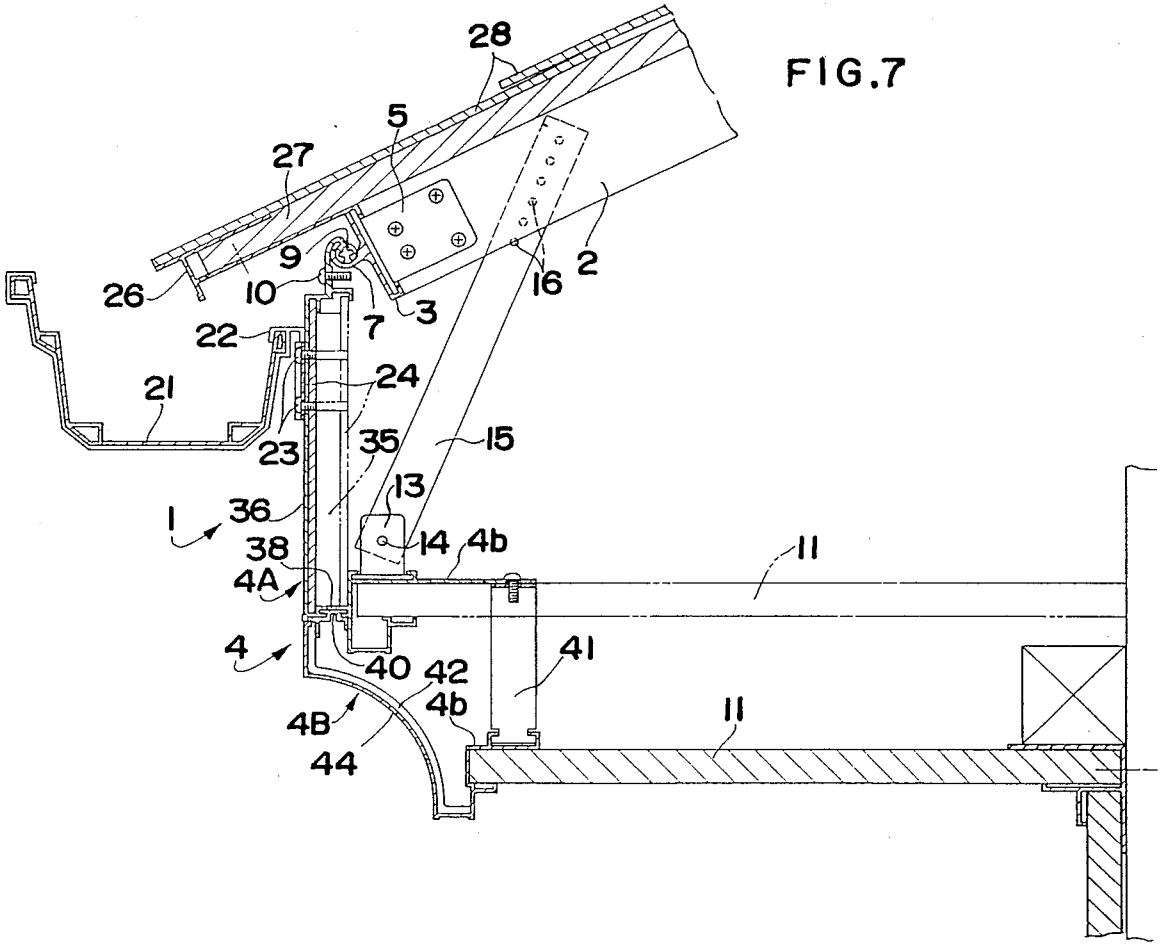

In FIG. 6, the secondary board member 4B designed to connect with the main board 4A is formed into an apparently outwards curved face, so as to bringing out a change in an appearance of the curtain board on the whole. On the other hand, in FIG. 7, the secondary board member 4B is formed into an apparently inwards curved face for the same purpose.

Figure 8:
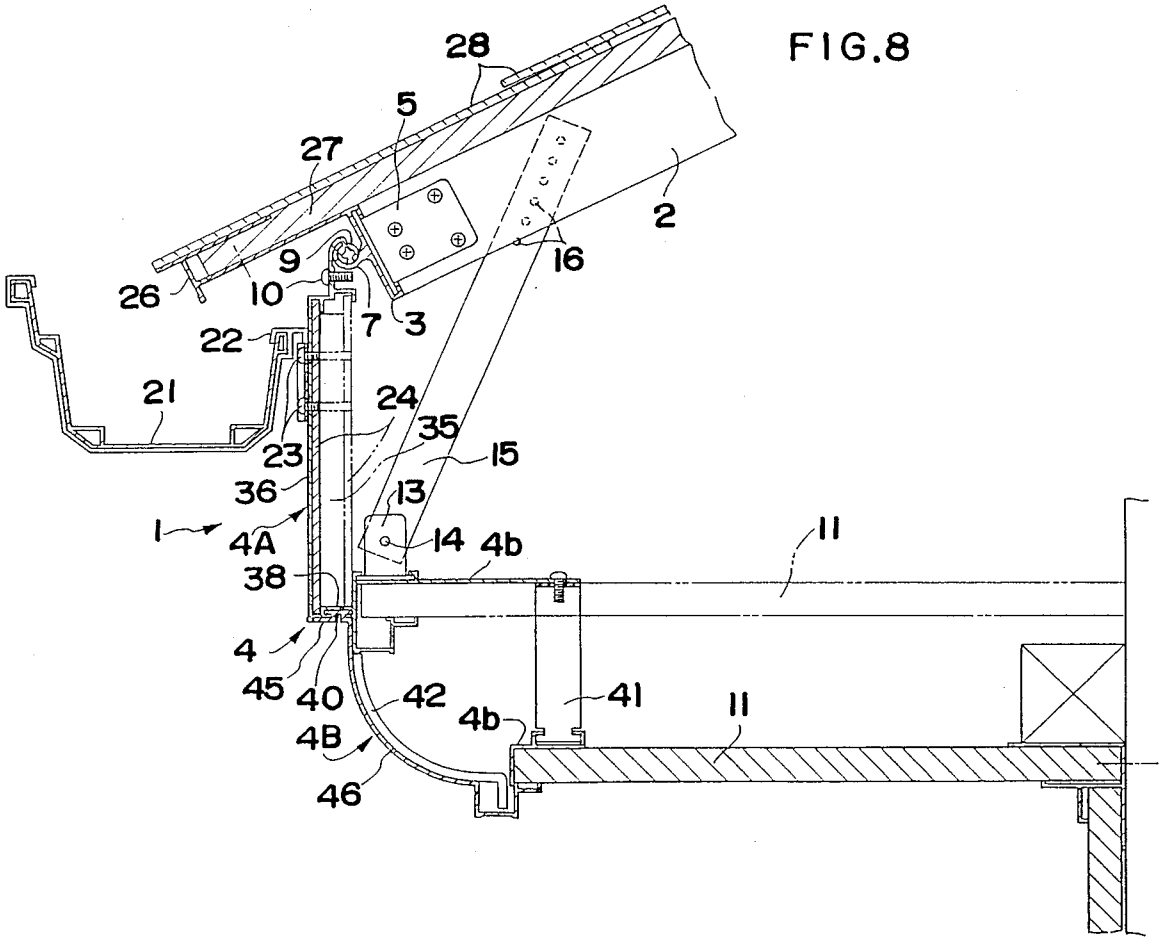
Figure 9:
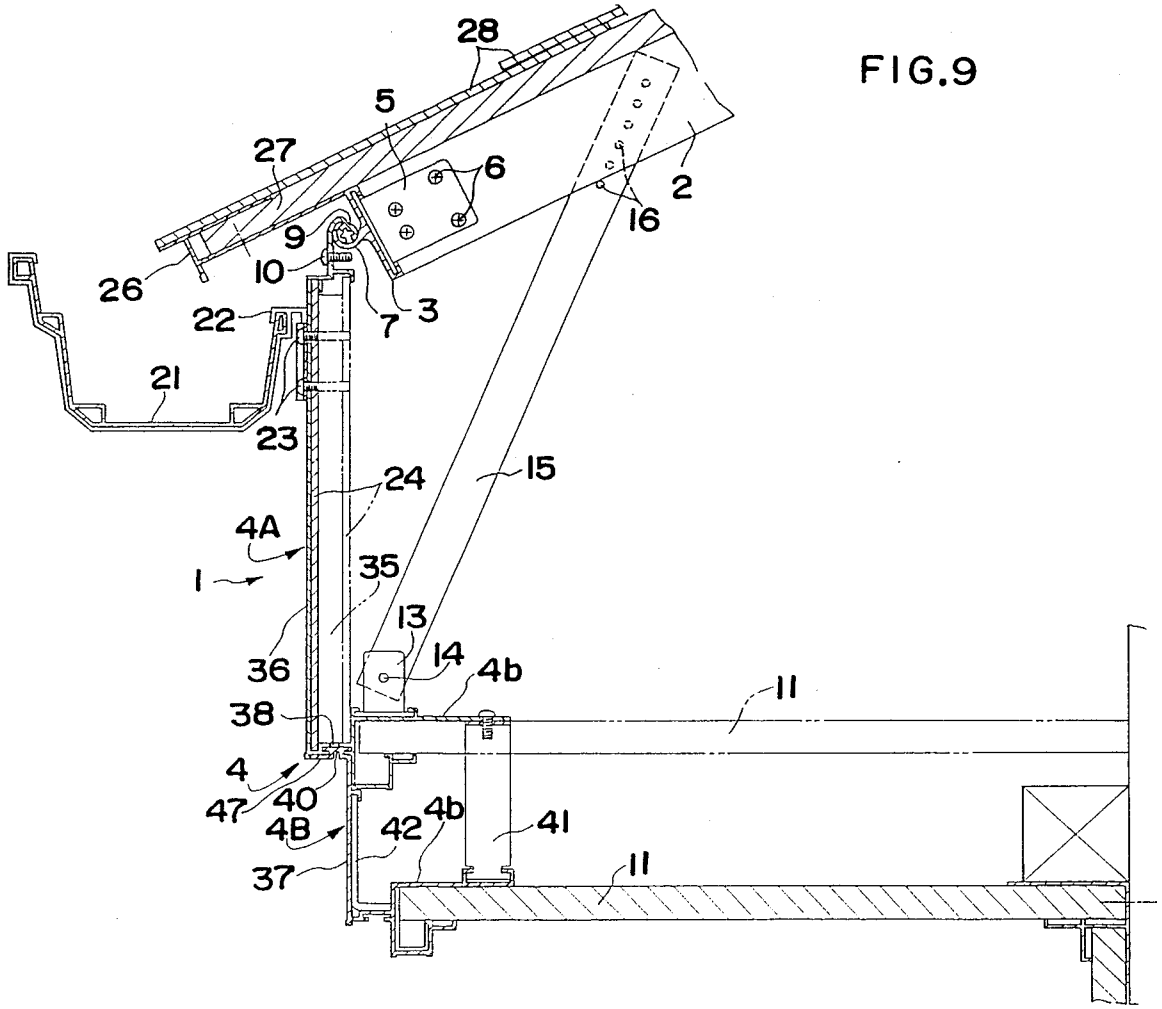

In FIG. 8, the lower secondary board 4B curved outwards as described in FIG. 6 is connected with the upper main board 4A at an inward position relative to the plane passing the main board 4A, so as to stick out the angular low terminal of the upper main board 4A. In the same way, in FIG. 9, the lower secondary board 4B having an even face as described in FIG. 5 is connected with the upper main board 4A at an inward position relative to the plane passing the main board 4A. As this result, the angular low terminal of the upper main board 4A stands out so as to bring out a change in an appearance of the curtain board 4 on the whole.

What is claimed is:

1. An assembly of fascia which comprises a fascia board for a building having outer walls, roof eaves, and rafters arranged in said roof eaves and having outer ends, said fascia board being adapted to conceal said outer ends of said rafters, an eaves soffit board inward and outward ends, said soffit board being set apart under said eaves for obstructing a view of the inside of said eaves from below, an inward end of the soffit board being fixed to an outer wall of the building, a curtain board for linking said fascia board and the outward end of said soffit board for masking a gap between the eaves and the soffit board, said fascia board has an outer side which is provided longitudinally and integrally with an outward protrusion having an upwards open concave groove for supporting said curtain board, an upper end portion of said curtain board being bent downward and provided at its extreme edge longitudinally and integrally with a handle portion to associate with said groove of the protrusion, said fascia board and said curtain board have a joint which is adapted to enable the curtain board to move relative to and around the fascia board, whereby the curtain board can be supported even when tilted, by the fascia board.

2. An assembly of eaves fascia as defined in claim 1 wherein a regulating means is arranged for preventing the hanging portion of the curtain board from slipping off the groove of the protrusion of the fascia board.

3. An assembly of eaves of fascia as defined in claim 1, further comprising a rain water gutter to an outer side of said curtain board.

4. An assembly of eaves fascia as defined in claim 1, wherein said curtain board is provided at its lower end portion longitudinally and integrally with a backward hollow sustaining portion for supporting the outward end of the soffit board in an inserted and sandwiched manner.

5. An assembly of eaves fascia as defined in claim 4, wherein the curtain board is supported in a tilted manner by way of a supplementary supporting arm for linking the rafter and the lower end portion of the curtain board.

6. An assembly of eaves fascia as defined in claim 4, wherein an additional curtain board is connected with said curtain board so as to extend downwards.

* * * * *